US010813408B2

(12) United States Patent
Urbin

(10) Patent No.: US 10,813,408 B2
(45) Date of Patent: Oct. 27, 2020

(54) TACTILE FEEDBACK SHOE SOLE

(71) Applicant: Adam Michaels Urbin, Westborough, MA (US)

(72) Inventor: Adam Michaels Urbin, Westborough, MA (US)

( * ) Notice: Subject to any disclaimer, the term of this patent is extended or adjusted under 35 U.S.C. 154(b) by 109 days.

(21) Appl. No.: 16/161,058

(22) Filed: Oct. 16, 2018

(65) Prior Publication Data

US 2020/0113282 A1 Apr. 16, 2020

(51) Int. Cl.
*A43B 13/18* (2006.01)
*A43B 5/06* (2006.01)

(52) U.S. Cl.
CPC ..... *A43B 13/189* (2013.01); *A43B 5/06* (2013.01); *A43B 13/186* (2013.01)

(58) Field of Classification Search
CPC ..... A43B 13/20; A43B 13/18; A43B 13/181; A43B 13/186–189
See application file for complete search history.

(56) References Cited

U.S. PATENT DOCUMENTS 1,069,001 A * 7/1913 Guy ..... A43B 7/06 36/29
1,605,985 A * 11/1926 Rasmussen ..... A43B 13/20 36/153
4,458,430 A * 7/1984 Peterson ..... A43B 13/20 36/28
4,864,737 A * 9/1989 Marrello ..... A43B 13/20 36/29
5,678,328 A * 10/1997 Schmidt ..... A43B 13/20 36/28
5,718,063 A * 2/1998 Yamashita ..... A43B 1/0072 36/28
5,894,687 A * 4/1999 Lin ..... A43B 7/146 36/141
6,745,499 B2 * 6/2004 Christensen ..... A43B 13/20 36/29
8,973,287 B2 * 3/2015 Shibata ..... A43B 7/144 36/141
9,320,320 B1 * 4/2016 Shamir ..... A43B 7/005
2005/0283999 A1 * 12/2005 Whatley ..... A43B 13/20 36/29

* cited by examiner

*Primary Examiner* — Kristen Matter

(57) ABSTRACT

A tactile feedback shoe sole for footwear comprising a main body that defines a toe portion, an arch portion and a heel portion. A first chamber filled with a fluid is disposed in the toe portion. A second chamber comprising a second chamber upper wall, a second chamber lower wall and projections is disposed in the heel portion. A channel is disposed at the arch portion between the first chamber and the second chamber. If the first chamber is pressurized first before exerting pressure on the second chamber, which is likely to happen when the user of the sole runs following a forefoot running technique, the fluid from the first chamber flows to the second chamber and the fluid in the second chamber does not allow contact of the heel of the user to come in contact of the projections present in the inflated second chamber.

10 Claims, 7 Drawing Sheets

TACTILE FEEDBACK SHOE SOLE

FIELD OF THE INVENTION

The present invention relates to footwear. More particularly, the present invention relates to providing feedback to a user of footwear toward attaining a desired gait during walking or running.

BACKGROUND OF THE INVENTION

Some runners/walkers strike the ground with their heel first, termed "rearfoot running" or "heel strike", and is arguably the most common foot strike pattern amongst runners. Then there is running/walking technique in which the ball of the foot touches the ground first, termed "forefoot running" or "forefoot strike" or "ball strike". Proponents of forefoot running believe that it is more natural and biomechanically faster than rearfoot running. Perhaps, when we run barefoot, almost everyone of us run on toes or forefoot. Forefoot strike running may also alleviate many of the harmful effects associated with heel strike running and, thus, can help reduce injury risks. So, a common trend in running nowadays is to transition from traditional rearfoot running form to forefoot running. But, this can be a difficult transition for people to make as they are changing a learned habit.

Prior art provides footwear articles which are suitable for forefoot strike or which support forefoot running. But, such products do not directly discourage a runner from being rearfoot runner.

Thus, there exists a need for a footwear article which helps a user in switching from one running technique to another.

OBJECTS OF THE INVENTION

An object of the present invention to provide a footwear article that gives feedback to a runner to change to forefoot running from rearfoot running or vice versa, as desired.

Another object of the present invention is to provide a footwear article that provides tactile feedback to a user without using any external power source.

Yet another object of the present invention is to provide an inexpensive feedback system toward attaining forefoot running technique.

Still another object of the present invention is to provide a footwear article that helps a user in correcting pronation and supination.

These as well as other objects of the present invention are apparent upon inspection of this specification, including the drawings attached hereto.

SUMMARY OF THE INVENTION

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The present invention is directed to a footwear article which can help a person to attain a desired walking or running technique. The footwear article of the present invention provides a tactile feedback to the user when the user fails to put the foot in the way that is required to attain a desired walking or running technique. The feedback mechanism does not require any external power source. The shoe sole of the present invention comprises a first chamber filled with a fluid disposed in the toe section of the sole and a second chamber having one or more projections disposed in the heel section of the sole. When the second chamber is inflated, the projections move away from the upper wall/surface of the second chamber. A channel is provided to bring the two chambers in fluid communication with each other when required. Under normal condition i.e. when no force is exerted on the first chamber or on the second chamber the first chamber remains filled with the fluid. If the first chamber is pressurized first before exerting pressure on the second chamber, which is likely to happen when the user of the sole walks or runs as per forefoot running or ball strike technique, the fluid from the first chamber flows to the second chamber and the fluid in the second chamber does not allow contact of the heel of the user to come in contact of the projections present in the inflated second chamber. But, if the heel of the user lands on the second chamber first before the first chamber gets compressed, which happens during heel strike or rearfoot running, the user feels discomfort on the heel because of the projections which come directly under the heel in absence of any shock absorbing fluid in the second chamber.

BRIEF DESCRIPTION OF THE DRAWINGS

In order to describe the manner in which features and other aspects of the present disclosure can be obtained, a more particular description of certain subject matter will be rendered by reference to specific embodiments which are illustrated in the appended drawings. Understanding that these drawings depict only typical embodiments and are not therefore to be considered to be limiting in scope, nor drawn to scale for all embodiments, various embodiments will be described and explained with additional specificity and detail through the use of the accompanying drawings in which.

DETAILED DESCRIPTION OF THE INVENTION

The following description is presented to enable any person skilled in the art to make and use the invention, and is provided in the context of particular applications of the invention and their requirements. Various modifications to the disclosed embodiments will be readily apparent to those skilled in the art and the general principles defined herein may be applied to other embodiments and applications without departing from the scope of the present invention. Thus, the present invention is not intended to be limited to the embodiments shown, but is to be accorded the widest scope consistent with the principles and features disclosed herein.

In the following detailed description, numerous specific details are set forth in order to provide a thorough understanding of the invention. However, it will be understood by those skilled in the art that the present invention may be practiced without these specific details. In other instances, well-known methods, procedures and components have not been described in detail so as not to obscure the present invention.

Figure 2A:
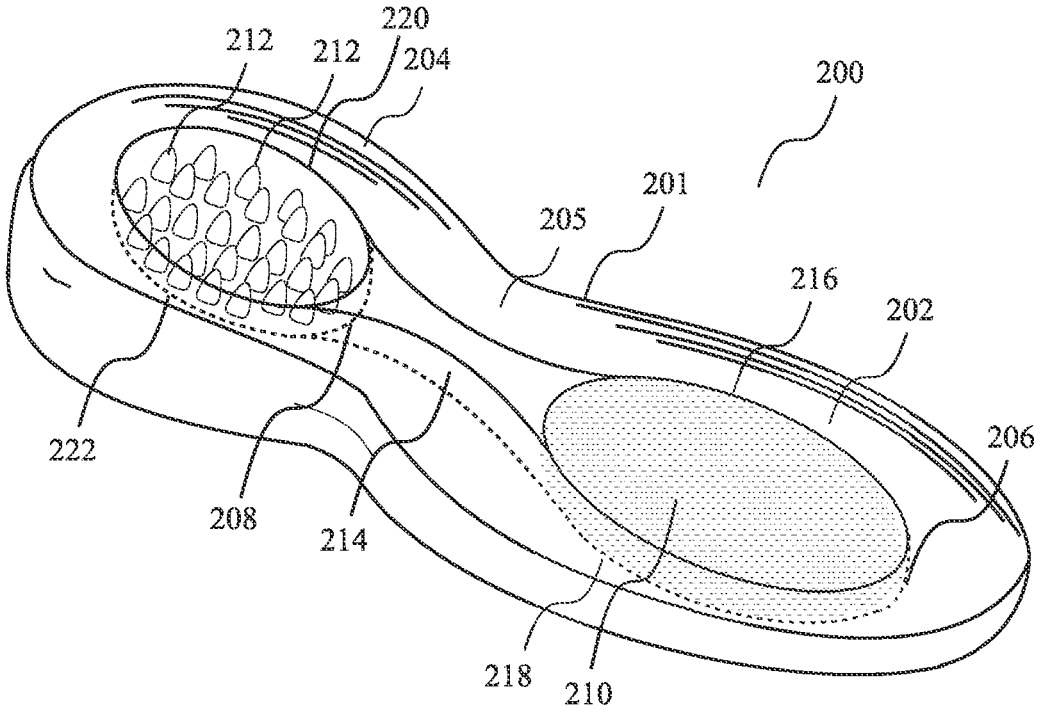
FIG. 2A illustrates perspective view of a tactile feedback shoe sole in accordance with an embodiment of the present invention.
Figure 2B:
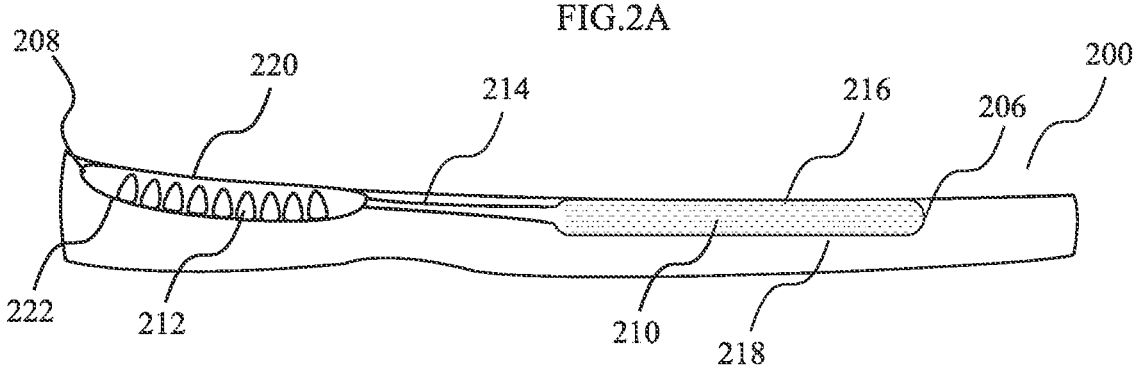
FIG. 2B is a side view of a tactile feedback shoe sole in accordance with an embodiment of the present invention.

FIGS. 2A and 2B illustrate a tactile feedback shoe sole 200 having a main body 201. The main body 201 comprises a front or toe portion 202, a rear or heel portion 204 and a middle or arch portion 205. The front portion 202 comprises a first bladder or first chamber or first chamber 206 having a first chamber upper wall 216 and a first chamber lower wall 218 spaced from said first chamber upper wall 216 and bonded together to cooperatively define a sealed toe space therebetween. The rear or heel portion 204 comprises a second bladder or second chamber or second chamber 208 having a second chamber upper wall 220 and a second chamber lower wall 222 spaced from said second upper wall 220 and bonded together to cooperatively define a sealed heel space therebetween. The upper walls 216, 220 and lower walls 218, 222 are made of flexible material which make the first chamber 206 and second chamber 208 squeezable and/or expandable under pressure/force and they retain their shape upon withdrawal of pressure on them.

In one embodiment, the first chamber 206 is filled with a fluid 210 which can be a viscous liquid or a gel or any other suitable fluid. In a preferred embodiment, a channel or conduit 214 is disposed at the arch portion 205 of the main body 201 between the first chamber 206 and second chamber 208 which, when required, enables in establishing a fluidic communication between the two chambers. In a preferred embodiment, the channel 214 comprises a restrictive gate which allows controlled dynamic flow of the fluid between the chambers.

Figure 2C:
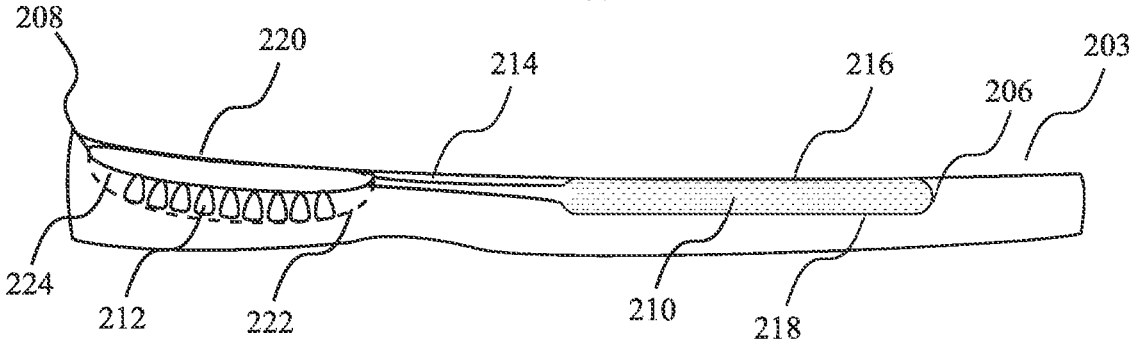
FIG. 2C illustrates a side view of another embodiment of the tactile feedback shoe sole of the present invention.

The second chamber 208 includes one or more projections 212 extending from the second chamber lower wall 222 and terminating below the second chamber upper wall 220. In a preferred embodiment, each of the projections 212 may have a predetermined dimension (e.g. a spike like shape and thickness) and the projections 212 are disposed on the second chamber lower wall 222 at positions which may correspond to the locations of the sensitive points of the heel of a person. In another embodiment 203 of the tactile feedback shoe sole, as shown in FIG. 2C, the second chamber 208 further comprises an intermediate wall 224 that separates the second chamber upper wall 220 and the second chamber lower wall 222 and the one or more projections 212 disposed on the second chamber lower wall 222 lie below the intermediate surface 224.

The tactile feedback shoe sole is configured in such a way that, when pressure is applied on the first chamber 206, it gets compressed and the fluid 210 present inside the first chamber 206 flows out of the first chamber 206 and travels through the channel 214 under pressure to enter the second chamber 208. In a preferred embodiment, the normal i.e. the unexpanded volume of the second chamber 208 is configured to be smaller than the volume of the first chamber 206. The chambers are preferably made of elastic material so that these chambers have the ability to resist a distorting influence and to return to their original size and shape when that influence or force is removed. As the second chamber 208 gets filled with the fluid 210, the space between the second chamber upper wall 220 and the second chamber lower wall 222 of the second chamber 208 increases. This results in increase in space between the second chamber upper wall 220 and the one or more projections 212 which are disposed on the second chamber lower wall 222 and the fluid 210 filling the space between the second chamber upper wall 220 and the projections 212 does not allow the second chamber upper wall 220 to touch the projections 212 even when pressure/force is applied on the second chamber 208 from outside.

Figure 1A:
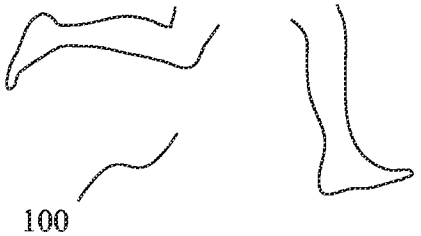
FIG. 1A illustrates side view of a runner's foot in a conventional rearfoot running and FIG. 1B to FIG. 1E illustrate different positions of the foot during the rearfoot strike run.
Figure 1B:
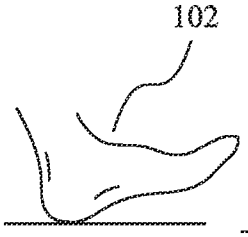
Figure 1C:
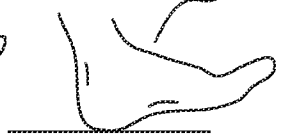
Figure 1D:
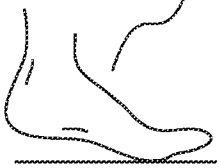
Figure 1E:
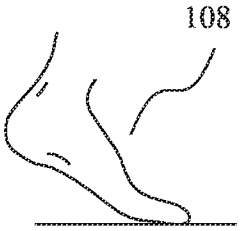
Figure 1F:
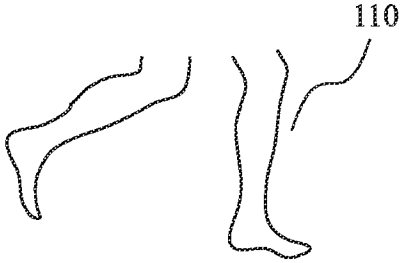
FIG. 1F illustrates side view of a runner's foot in a forefoot running technique and FIG. 1G to FIG. 1J illustrate different positions of the foot during the forefoot strike run.
Figure 1G:
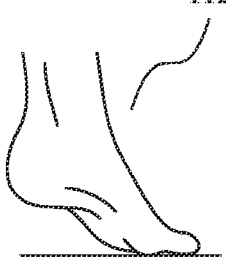
Figure 1H:
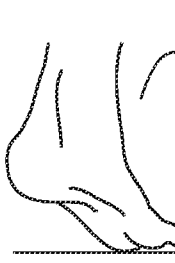
Figure 3A:
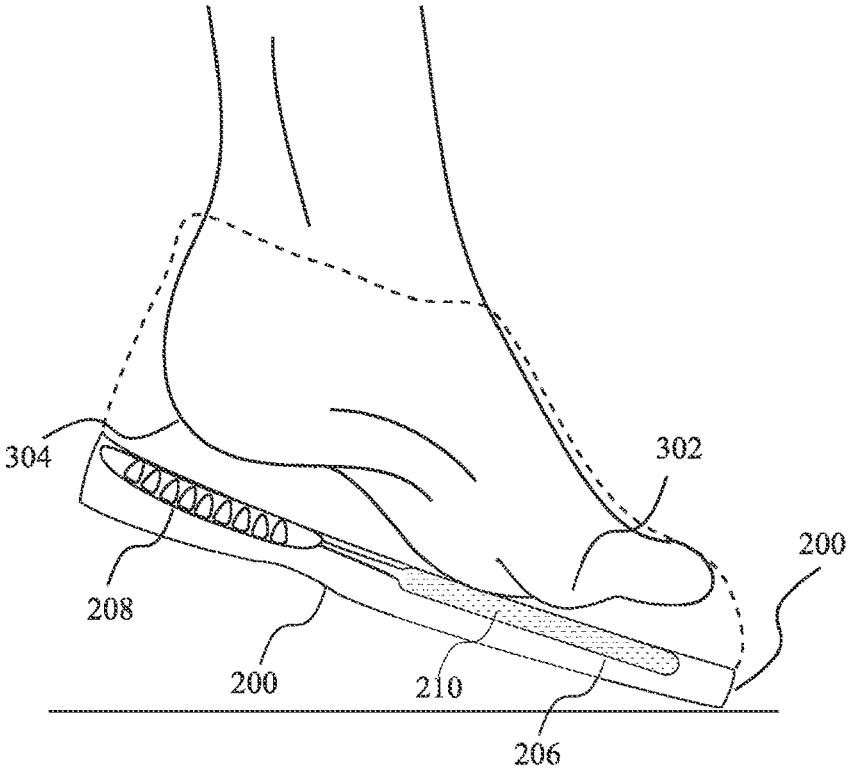
FIG. 3A illustrates a side view of a runner's foot along with the tactile feedback shoe sole before striking the ground in a forefoot running in accordance with an embodiment of the present invention.
Figure 3B:
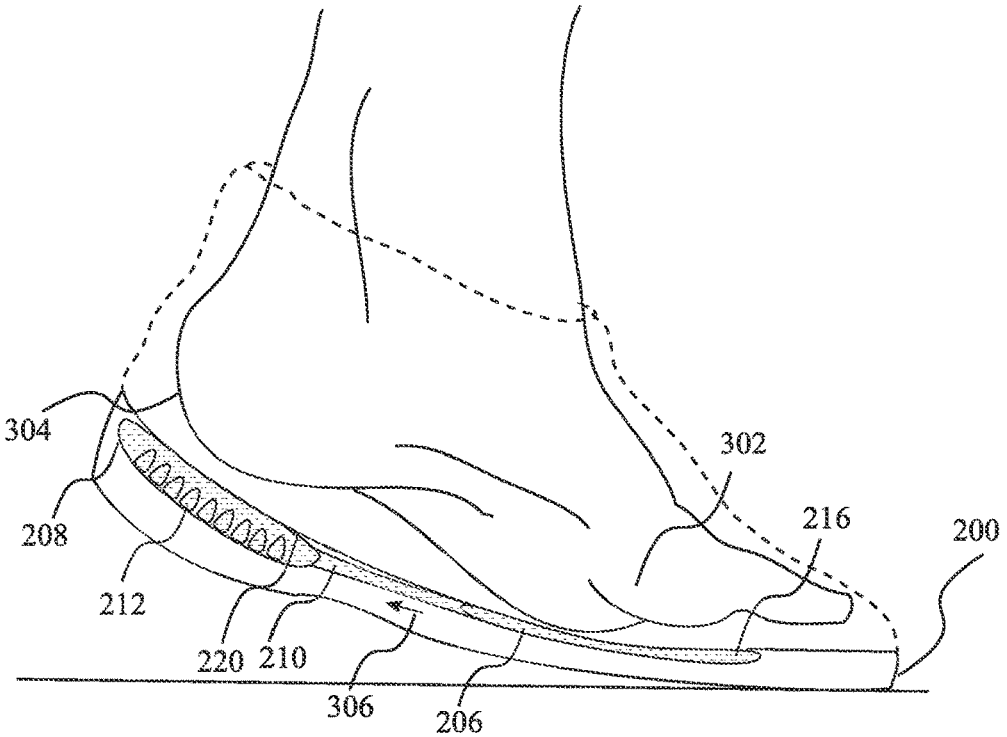
FIG. 3B illustrates side view of a runner's foot with the tactile feedback shoe sole during the forefoot strike on the ground in a forefoot running in accordance with an embodiment of the present invention.

FIGS. 1F to 1J illustrate various positions of the foot during ball strike running. With reference to FIGS. 1F to 1H, when the foot 110 strikes the ground in forefoot running, the ball of the foot strikes the ground at foot position 112 and then transitions to position 114. FIG. 3A shows tactile feedback shoe sole 200 corresponding to foot position 112 of forefoot running. At this position, the ball 302 of the foot starts to exert pressure on first chamber 206 which remains filled with fluid 210. As the foot lands further on the ground the first chamber 206 gets compressed under the pressure exerted by the ball 302 of the foot and, as shown in FIG. 3B, the fluid 210 starts flowing out in the direction 306 through the channel 214 to fill up second chamber 208. The compression of the first chamber 206 helps in absorbing the impact with which the ball of the foot strikes the ground.

Figure 1I:
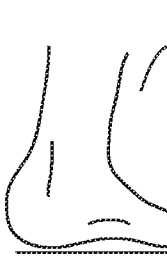
Figure 1J:
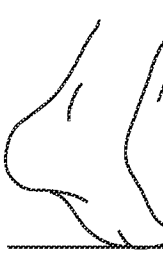
Figure 4A:
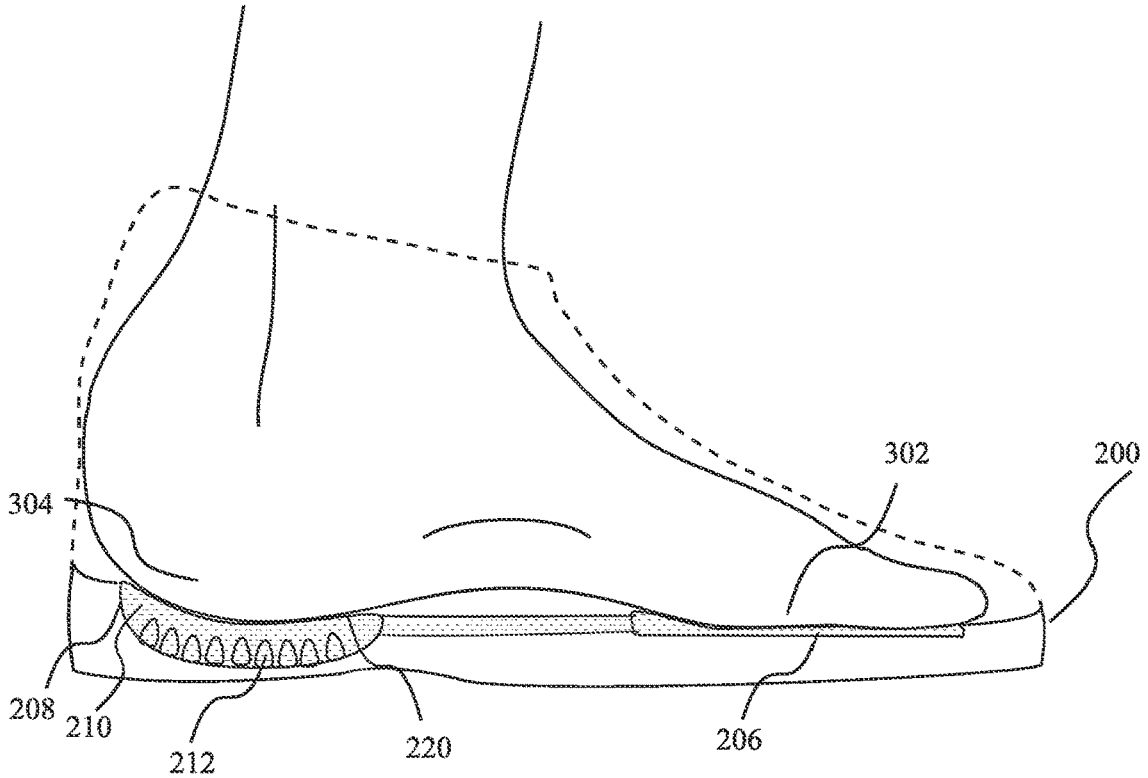
FIG. 4A illustrates side view of a runner's foot with the tactile feedback shoe sole with heel of the runner's foot resting on the heel portion of the tactile feedback shoe sole during forefoot running in accordance with an embodiment of the present invention.
Figure 4B:
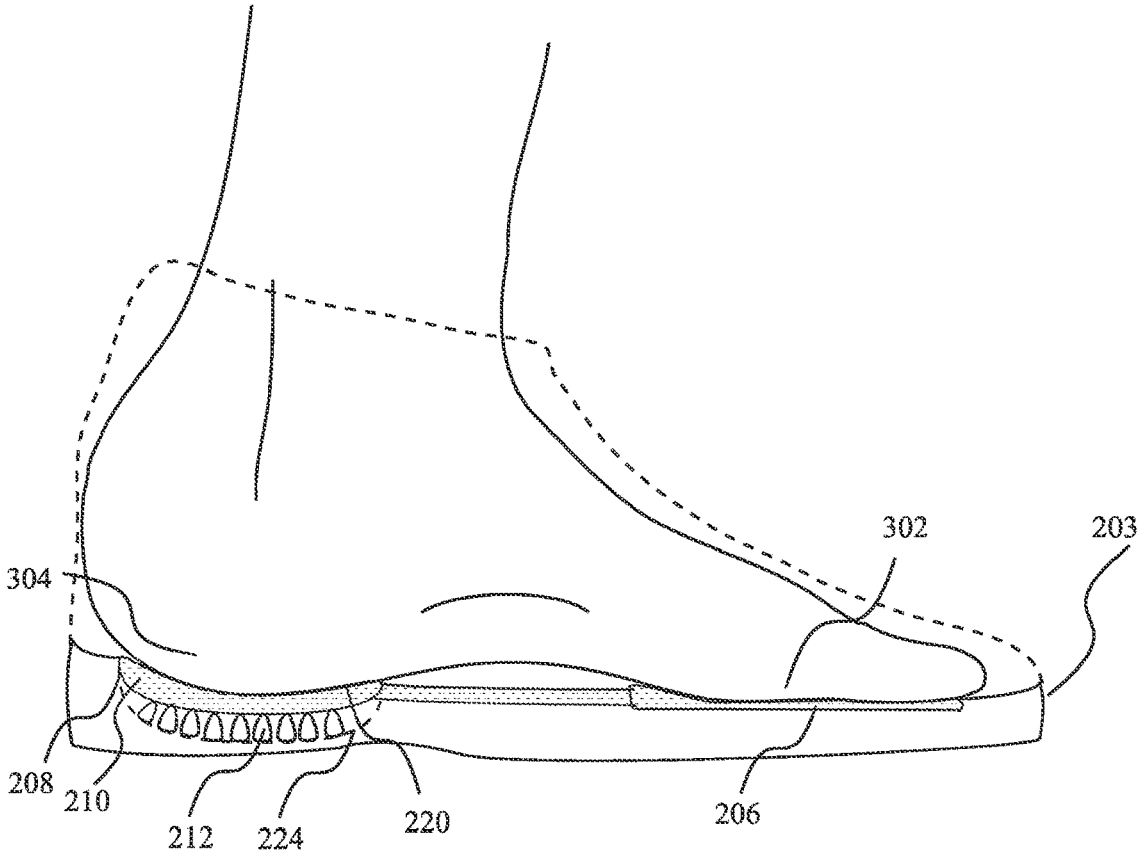
FIG. 4B illustrates side view of a runner's foot with the tactile feedback shoe sole with heel of the runner's foot resting on the heel portion of the tactile feedback shoe sole during forefoot running in accordance with a second embodiment of the present invention.

Position of the foot in FIG. 4A corresponds to the position 116 shown in FIG. 1I. At this position the whole foot i.e. the heel 304 along with the toe 302 rests on the tactile feedback shoe sole 200. Since the second chamber 208 is already filled up with fluid 210 due to compression of the first chamber 206, which has happened before the heel 304 strikes the second chamber 208, the expanded volume of the second chamber 208 attenuates and cushions impact of the heel 304 and presence of projections 212 doesn't cause any discomfort to the user and the user doesn't even feel the presence of the projections in the sole. FIG. 4B illustrates the same phenomenon occurring with the embodiment of the tactile feedback shoe sole 203. In this embodiment also the second chamber 208, inflated with fluid 210, doesn't allow the projections 212 to come in contact with the heel 304 thereby avoiding causing discomfort to the user which otherwise would have come in contact with the heel 304 had the second chamber 210 been not inflated.

Figure 5A:
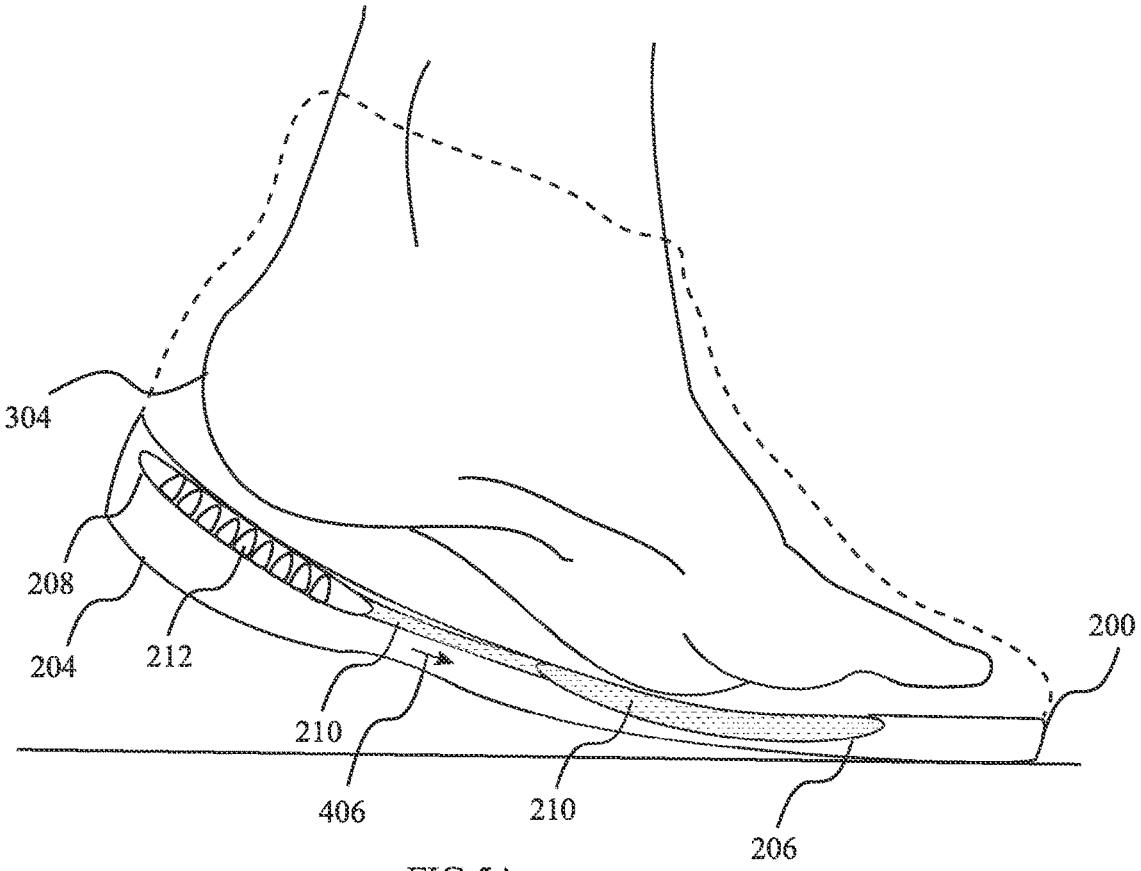
FIG. 5A illustrates side view of a runner's foot with the tactile feedback shoe sole when the heel of the runner's foot lifts from the ground during forefoot running in accordance with an embodiment of the present invention.

As with any other footwear article, the tactile feedback shoe sole 200 or 203, when worn by an individual, during running for example, repetitively contacts the ground surface and, following each contact, disengages from the playing surface. During a forefoot running, as described above with reference to FIGS. 3A, 3B, 4A & 4B, the first chamber 206 is compressed first and the second chamber 208 gets expanded due to the fluid 210 pushed from the first chamber 206. When the heel portion 204 disengages from the ground, as shown in FIG. 5A, corresponding to foot position 118 of FIG. 1J of forefoot running, the second chamber 208 tends to return to its initial unexpanded state. As soon as the foot completely lifts off the ground, a pressure differential develops between the second chamber 208 which tends to regain its unexpanded size and shape and the first chamber 206 which is at an uncompressed or partially compressed state. As a result, the fluid 210 flows back in the direction 406 from the second chamber 208 to the first chamber 206 through the channel 214. The chamber 206 and 208 are so configured that, to equalize the pressure differential, the second chamber 208 gets emptied fully or partially of the fluid 210 which flows back to the first chamber 206. This way, the tactile feedback shoe sole regains its designed configuration/state of normally filled first chamber 206 and empty (partially or fully) second chamber 208 before the next step in the walking/running process. In a preferred embodiment, the channel 214 controls the fluid communication between the first chamber 206 and the second chamber 208 by not allowing flow of the fluid 210 from first chamber 206 to second chamber 208 unless the first chamber 206 is compressed and a pressure gets built up inside the first chamber 206 to overcome resistance offered by the second chamber 208 against its expansion.

Figure 5B:
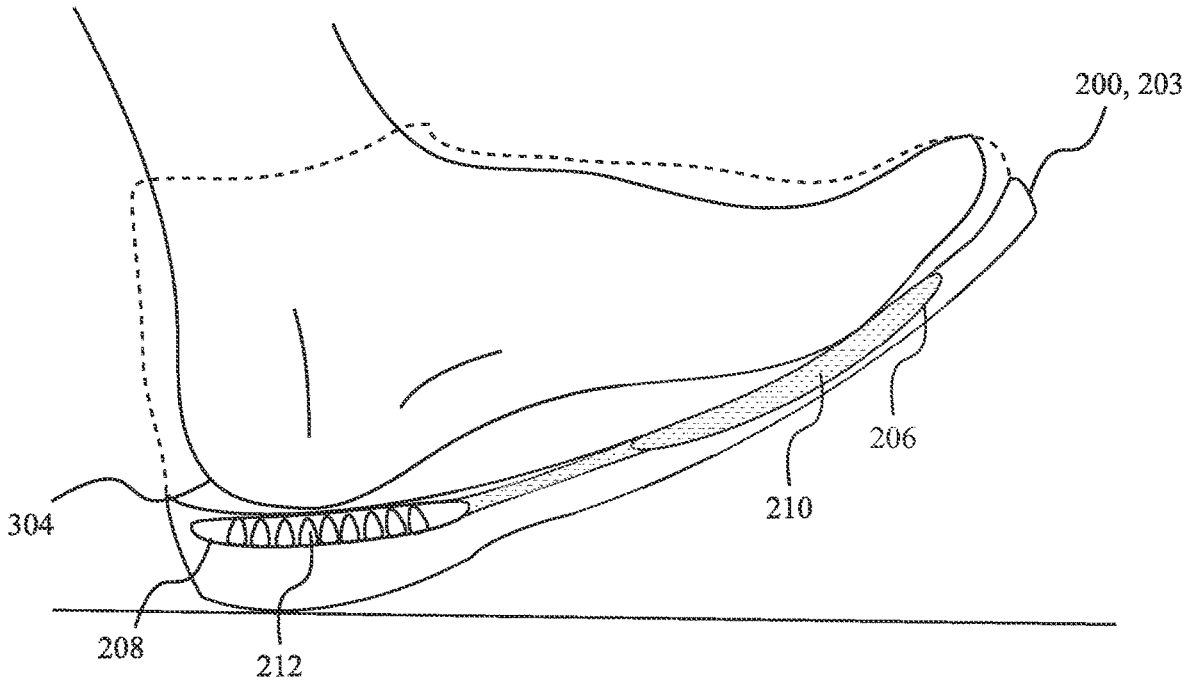
FIG. 5B illustrates side view of a runner's foot with the tactile feedback shoe sole with heel of the runner's foot resting on the heel portion of the tactile feedback shoe sole during strike of the heel during a rearfoot running in accordance with an embodiment of the present invention.

FIGS. 1A to 1E illustrate the conventional heel strike or rearfoot running technique in which the heel at position 100 (positions 102 and 104 as shown in close-up in FIGS. 1B and 1C) strikes the ground first. In FIG. 5B the foot along with a footwear article using the tactile feedback shoe sole 200 or 203 is shown corresponding to foot positions 102 and 104. In rearfoot running the heel strikes the ground first. So, unlike in forefoot running wherein the second chamber 208 is filled with the fluid before the heel 304 comes to rest on the heel portion 204, the second chamber 208 remains empty (fully or partially) when the user follows rearfoot running technique i.e. both the first chamber 206 and the second chamber 208 remain in their normal size and shape. Thus, in rearfoot running, when the heel 304 rests on the second chamber 208 during the heel strike, the one or more projections 212 come directly against the heel 304 and press against the heel. The contact of the projections against the heel of the user may act as a feedback to the user of the tactile feedback shoe sole to indicate that the user is following a rear foot or heelstrike running technique rather than forefoot running technique. In forefoot running, the second chamber gets filled with the fluid before the heel strike and, thus, the heel does not feel the projections due to the cushioning provided by the presence of the fluid in the second chamber.

It can be seen from the above description that the projections placed in the second chamber can make the user of the tactile feedback shoe sole aware of their presence by way of pressing against the heel of the user if the heel lands on the heel portion of the sole prior to the toe of the user landing on the toe portion of the sole. This happens because of the design of the tactile feedback shoe sole which makes the second chamber remain devoid of fluid partially or fully with the projections lying directly below the upper surface of the second chamber until the first chamber filled with the fluid is sufficiently compressed. In conventional rearfoot running the heel always strikes the ground before the toe makes contact with the ground in every step/stride. Thus, whenever a user walks or runs in heelstrike or rearfoot technique using the tactile feedback shoe sole, the heel of the user is going to feel the projections upon impact. But, the user will not be able to feel the projections if the upper wall of the second chamber is not allowed to come in contact with the projection even under downward external pressure. This can be achieved by making the second chamber expand volumetrically thereby increasing the distance between the upper wall and the projections. The volumetric expansion in the second chamber can be created by pumping in the fluid from the first chamber when the first chamber is compressed before the heel lands on the heel portion i.e. when the first chamber is compressed but the second chamber is not compressed. Thus, the shoe sole of the present invention provides tactile feedback to a user of the shoe sole by way of the projections pressing against the heel when the heel of the user lands before the toe strikes the ground in a step as it happens in rearfoot running. No such feedback is given by the shoe sole of the present invention when the user runs or walks adopting the forefoot running or ball strike technique.

Figure 6:
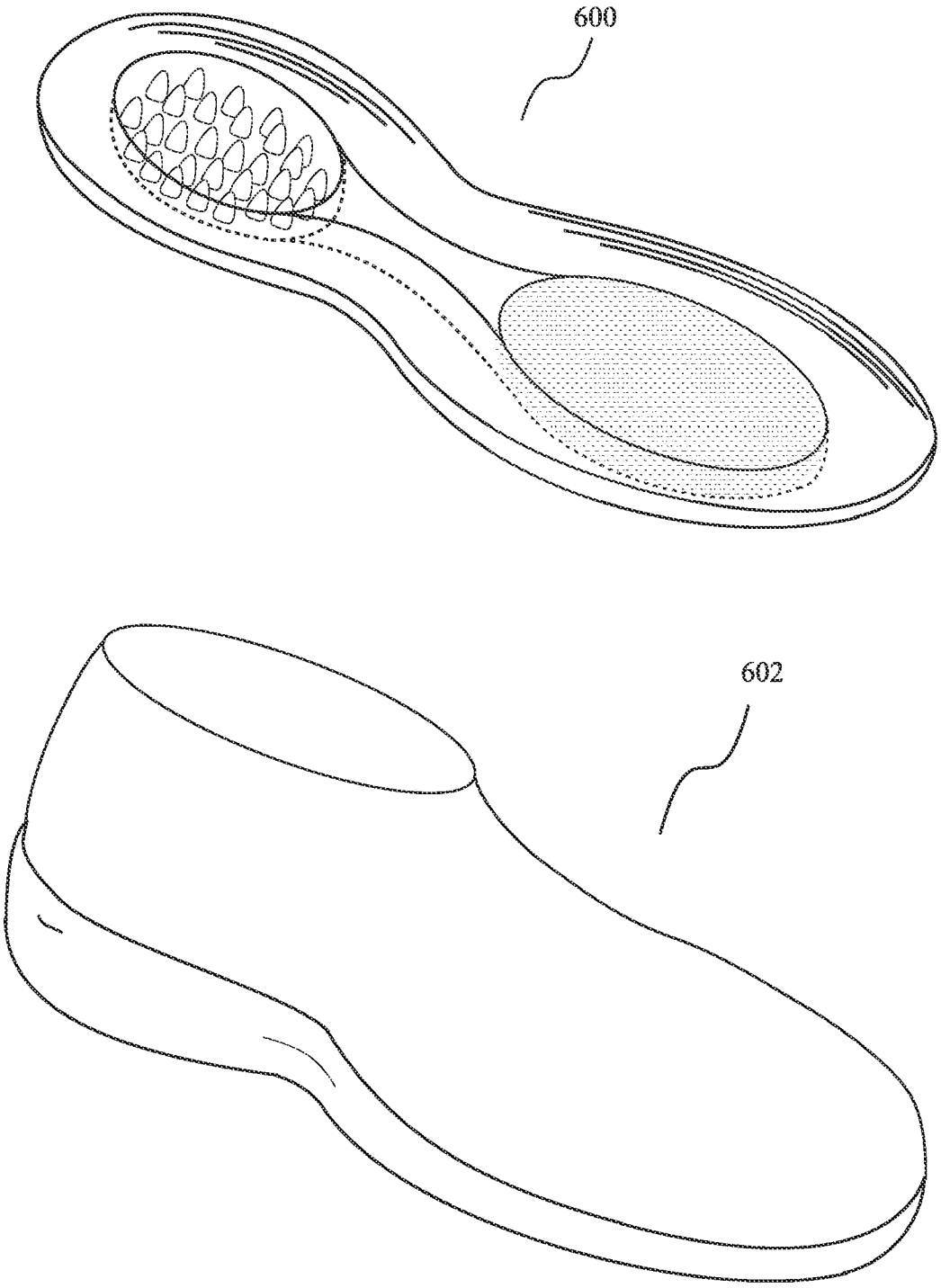
FIG. 6 illustrates perspective view of an insertable tactile feedback shoe sole in accordance with a third embodiment of the present invention and a shoe.

FIG. 6 illustrates another embodiment of the tactile feedback shoe sole 600 which works in line with the principle of embodiments 200 or 203 but is an insole instead of being an integral part of a footwear article. The tactile feedback shoe sole 600 can be inserted into any conventional shoe such as 602 shown in FIG. 6.

Figure 7:
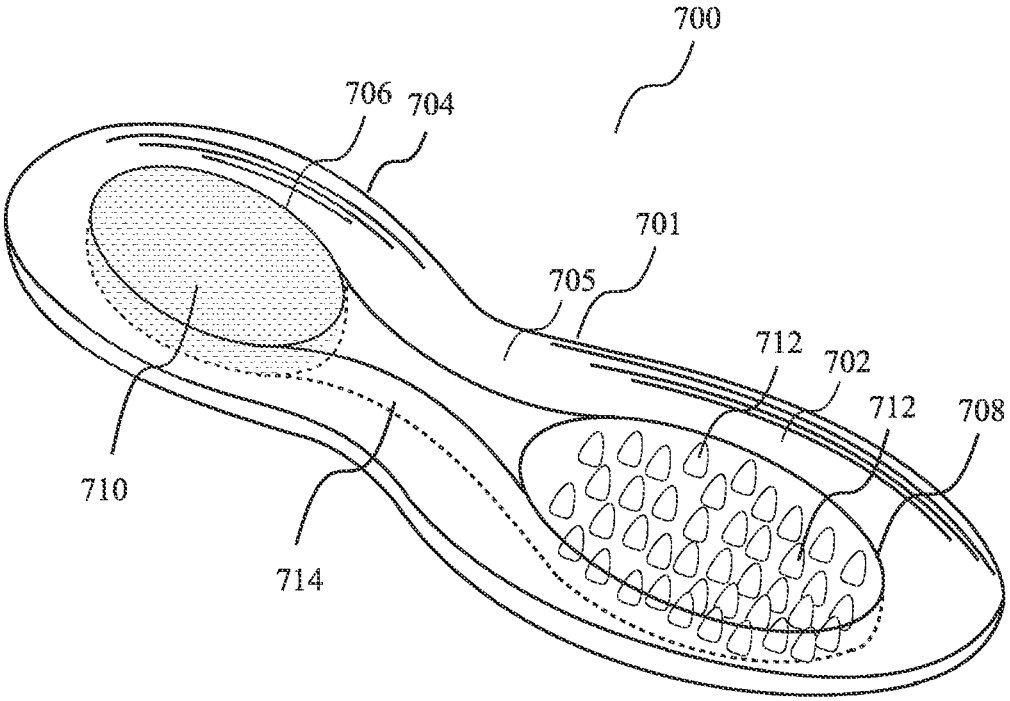
FIG. 7 illustrates perspective view of the tactile feedback shoe sole for rearfoot running in accordance with a fourth embodiment of the present invention.

Although, the present invention has been described above in the context of encouraging forefoot running, in some embodiments, the tactile feedback shoe sole can be configured to provide feedback for encouraging rearfoot running, if required. In this embodiment, as shown in FIG. 7, the first chamber 706 is disposed in the rear portion 704 and the second chamber 708 is disposed in the toe portion 702 of the tactile feedback shoe sole 700. In this embodiment also the first chamber 706 is filled with a fluid 710 and a channel 714 is disposed at the arch portion 705 of the main body 701 between the first chamber 706 and second chamber 708 which, when required, enables establishing of a fluidic communication between the two chambers. The embodiment 700 works in the same principle on which the embodiments 200, 203 or 600 work. In this embodiment, if the toe of the user strikes the ground first before the heel does, the user would feel the projections 712 under his/her toe as the toe chamber 708 would remain empty and unexpanded. But, if the heel strikes first then the first chamber 706 having the fluid 710 would cushion the impact of the heel and the fluid would flow to the second chamber 708. So, subsequently, when the toe comes down (foot positions 106 and 108 shown in FIGS. 1D and 1E) it would land on the second chamber 708 filled with the fluid 710 and, as a result, the toe would not feel the projections.

In some embodiments, the first chamber and the second chamber can have multiple sub-chambers. Each of the sub-chambers can be connected to each other or to one or more of the sub-chambers of the first chamber may remain directly in fluid communication with one or more sub-chambers of the second chamber through one or more channels.

What is claimed is:

1. A tactile feedback shoe sole for footwear comprising:

a main body that defines a toe portion, an arch portion and a heel portion;

a first chamber disposed in said toe portion, said first chamber configured to remain filled with a fluid when said first chamber is in an uncompressed state;

a second chamber disposed in said heel portion, said second chamber having a second chamber upper wall, a second chamber lower wall spaced from said second chamber upper wall and one or more projections disposed on said second chamber lower wall, said second chamber being configured to allow said second chamber upper wall to come in contact with said one or more projections when said second chamber is in a compressed state under an external pressure and said first chamber is in said uncompressed state; and a channel disposed at said arch portion between said first chamber and said second chamber, said channel being configured to establish a fluidic communication between said first chamber and said second chamber when required;

wherein, said fluid flows from said first chamber to said second chamber through said channel and said fluid fills said second chamber to prevent said second chamber upper wall from coming in contact with said one or more projections even under said external pressure when, during a gait cycle, said first chamber is in a compressed state before said second chamber is in said compressed state and said fluid flows back to said first chamber when said first chamber is in said uncompressed state and said second chamber is in said compressed state.

2. The tactile feedback shoe sole as in claim 1, wherein said second chamber is smaller than said first chamber in volume in unexpanded state.

3. The tactile feedback shoe sole as in claim 1, wherein said channel comprises a restrictive gate that allows controlled dynamic flow of said fluid between said first chamber and said second chamber.

4. The tactile feedback shoe sole as in claim 1, wherein said first chamber and said second chamber are configured to return to their original size and shape when said external pressure is withdrawn.

5. The tactile feedback shoe sole as in claim 1, wherein said one or more projections disposed on said second chamber lower wall extend from said second chamber lower wall and terminate below said second chamber upper wall.

6. A tactile feedback shoe sole for footwear comprising:

a main body that defines a toe portion, an arch portion and a heel portion;

a first chamber disposed in said heel portion, said first chamber configured to remain filled with a fluid when said first chamber is in an uncompressed state;

a second chamber disposed in said toe portion, said second chamber having a second chamber upper wall, a second chamber lower wall spaced from said second chamber upper wall and one or more projections disposed on said second chamber lower wall, said second chamber being configured to allow said second chamber upper wall to come in contact with said one or more projections when said second chamber is in a compressed state under an external pressure and said first chamber is in said uncompressed state; and a channel disposed at said arch portion between said first chamber and said second chamber, said channel being configured to establish a fluidic communication between said first chamber and said second chamber when required;

wherein, said fluid flows from said first chamber to said second chamber through said channel and said fluid fills said second chamber to prevent said second chamber upper wall from coming in contact with said one or more projections even under said external pressure when, during a gait cycle, said first chamber is in a compressed state before said second chamber is in said compressed state and said fluid flows back to said first chamber when said first chamber is in said uncompressed state and said second chamber is in said compressed state.

7. The tactile feedback shoe sole as in claim 6, wherein said second chamber is smaller than said first chamber in volume in unexpanded state.

8. The tactile feedback shoe sole as in claim 6, wherein said channel comprises a restrictive gate that allows controlled dynamic flow of said fluid between said first chamber and said second chamber.

9. The tactile feedback shoe sole as in claim 6, wherein said first chamber and said second chamber are configured to return to their original size and shape when said external pressure is withdrawn.

10. The tactile feedback shoe sole as in claim 6, wherein said one or more projections disposed on said second chamber lower wall extend from said second chamber lower wall and terminate below said second chamber upper wall.

* * * * *